United States Patent [19]

Skogberg

[11] Patent Number: 4,487,528

[45] Date of Patent: Dec. 11, 1984

[54] EARTH ANCHORING EXPANSION BODY HAVING FOLDED SHEET METAL CASING

[75] Inventor: Bo T. Skogberg, Handen, Sweden

[73] Assignee: Atlas Copco Aktibolag, Nacka, Sweden

[21] Appl. No.: 439,557

[22] Filed: Nov. 5, 1982

[30] Foreign Application Priority Data

Nov. 16, 1981 [SE] Sweden ..... 8106783

[51] Int. Cl.[3] ..... E21D 20/00; E21D 21/00

[52] U.S. Cl. ..... 405/259; 405/244; 405/258

[58] Field of Search ..... 405/259, 260, 261, 244; 166/179, 187; 277/34

[56] References Cited

U.S. PATENT DOCUMENTS

| | | | |
|---|---|---|---|
| 2,629,446 | 2/1953 | Freling et al. | 277/34 |
| 2,851,111 | 9/1958 | Jones | 277/34 X |
| 2,922,478 | 1/1960 | Maly | 166/187 X |
| 3,066,739 | 12/1962 | Saurenman et al. | 166/187 X |
| 3,494,134 | 2/1970 | Jorge | 405/260 |
| 3,940,152 | 2/1976 | Fournier | 277/34 |

FOREIGN PATENT DOCUMENTS

| | | | |
|---|---|---|---|
| 2015057 | 9/1979 | United Kingdom | 405/259 |

*Primary Examiner*—Dennis L. Taylor

*Attorney, Agent, or Firm*—Frishauf, Holtz, Goodman and Woodward

[57] ABSTRACT

An expansion body for constructions like piles or anchorages located in the earth, said body being adapted for insertion into the ground in a compact shape and expanded therein to an expanded shape. The expansion is achieved by unfolding a folded sheet metal casing (11) by filling it up with pressurized fluid. The sheet metal casing which defines two opposed portions (16, 17) is folded in a zigzag shape before the expansion with the folds (18) of one portion (16) falling into the folds (19) of the other portion (17).

14 Claims, 13 Drawing Figures

2
3
4
11
12
13
14
16
17
18
19
20
21
22
23
24

EARTH ANCHORING EXPANSION BODY HAVING FOLDED SHEET METAL CASING

BACKGROUND OF THE INVENTION

This invention relates to an expansion body for constructions located in the earth including a folded elongated casing which defines an internal closed space connectable to a source of pressurized fluid for the expansion of the body by pressing out the folds of the casing.

Expansion bodies of the kind mentioned above have been proposed for in situ piles and especially as an expanded foot of these. When using such piles, first the casing is inserted into the ground and then filled with pressurized water or concrete for pressing out the folds, thereof thus giving the pile its final shape. Expansion bodies according to these known proposals have, however, been of negligible practial use since they are complicated and expensive to manufacture. Further, the degree of expansion is not sufficient for all applications.

An object of the present invention is therefore to provide an expansion body which is easy to manufacture and which has a considerably greater possibility to expand.

The invention will be further described in connection with the drawings.

DETAILED DESCRIPTION

Figure 6:
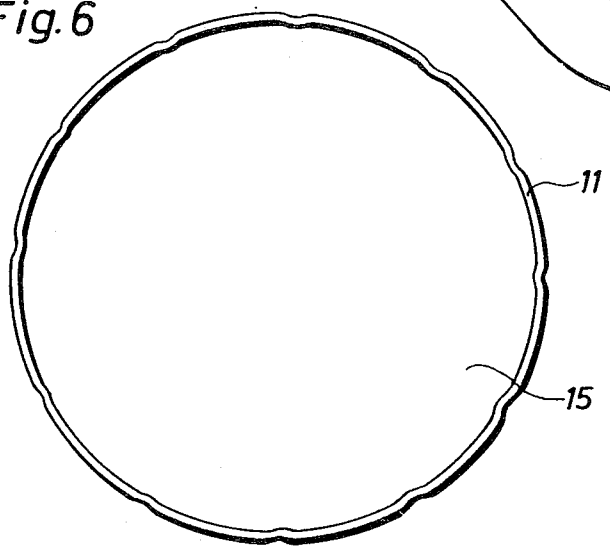
FIG. 6 is a sectional view taken on line 6—6 of FIG. 5.

The expansion body according to FIGS. 1–4 includes a folded elongated casing 11, clamping means 12, 13 arranged on each end part of the casing 11 and a filler tube 14 for the insertion of pressurized fluid into an internal closed space 15 (see FIG. 6) in the body. The casing 11 which preferably is made from sheet metal is folded in zigzag shape defining two opposed portions 16, 17 with the folds 18 of one portion 16 falling into the folds 19 of the other portion 17. The clamping means 12 at the front end of the casing 11 includes a sleeve 20 and a bolt 21 which penetrates the sleeve 20 and the folds 18, 19. The rear clamping means 13 only comprises a bolt 22 which penetrates the folds 18, 19. The clamping means 12, 13 are adapted for sealingly keeping the portions 16, 17 tightly adjacent to each other during the expansion but it is also necessary to provide for some sliding motion between the folds in the clamped parts of the casing, otherwise extreme tensions will appear close to the clamping means 12, 13 which tensions might cause the casing 11 to crack. For that reason anti-friction means 23 are arranged between one or more of the folds, preferably between each fold. Said means 23 preferably comprises metallic or other sheets of a sufficient hardness also to serve as a spacer in order to get suitable roundings of the folds when the clamping means are attached. The filler tube 14 is inserted between the portions 16, 17 and is sealingly attached to these by welding or glueing. The tube 14 can alternatively be inserted through the side of the casing 11 and welded directly thereto.

The folded casing can be manufactured in different ways, but it is preferred to start from a double layer of sheet-metal which is folded in zigzag. The double layer is alternatively made from a double folded rectangular metal sheet, or two sheets one laid over the other and welded together along one edge, or a flattened thin-walled tube. The sheet or tube should be of standard quality with sufficient softness for not being cracked by the folding and unfolding motion to which the steel is subjected during the manufacture and use of the expansion body. The double layer is successively folded starting from the edge of the layer which has the joined sheets and simultaneously the anti-friction means 23 are put between the folds. After the folding action the sheets of the opposite edge of the layer are joined together by a welding seam 24 if not a flattened tube has been used, and then the expansion body is completed by attaching the clamping means 12, 13 and filler tube 14.

Another preferred way of manufacturing the casing is by rolling sheet iron to zig-zag shaped sheets. One folded and suitable cut sheet is then laid over another so that the folds fall into each other. Thereafter the double sheet is pressured from the longitudinal sides so the folds are pressed to abutment against each other and finally the two longitudinal side edges are welded together. If there is need for a through channel in the casing, for example to provide space for an inlet or a through rod, the middle fold of the sheet is made different from the other ones so that this particular fold does not fail into the meeting fold of the other sheet.

Figure 5:
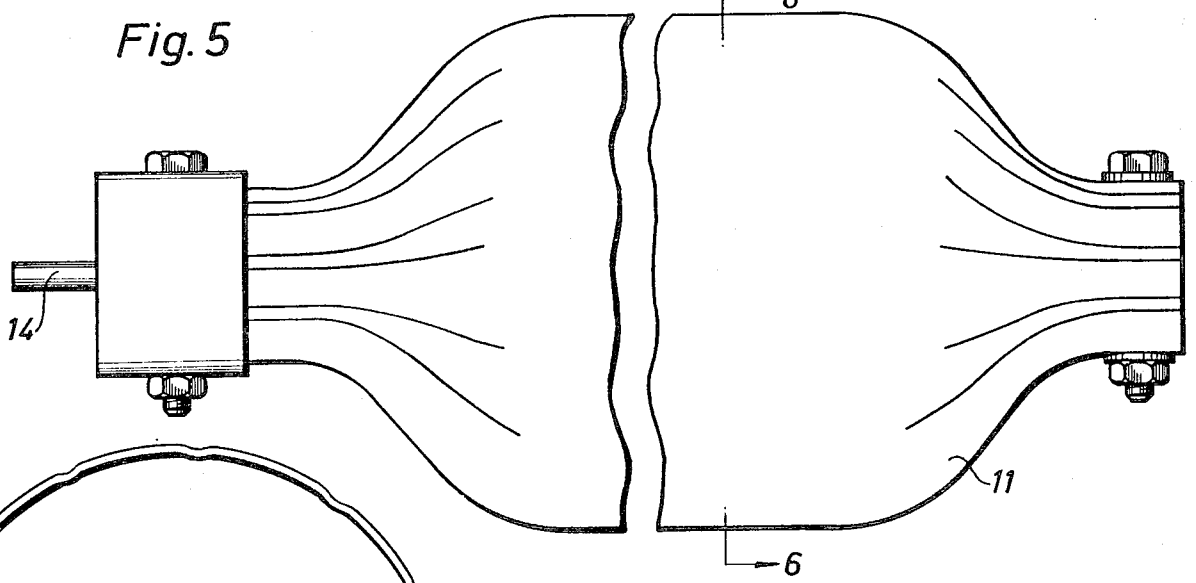
FIG. 5 is a side view of the body according to FIG. 1 but after expansion.

When expanding the expansion body, pressurized fluid led inbetween the two casing portions 16, 17 which start to separate from each other. The separation starts with one fold and successively continues with the other ones until the casing is totally expanded, see FIGS. 5 and 6. During the separation the folds in the clamped end parts slightly move about the bolt 21, 22 axis, the folds 18, 19 of the opposed portions being moved in opposed directions. The cross section of the expanded casing 11 reaches a diameter which increases the same diameter of the non-expanded casing 11 by 3–5 times depending on the thickness of the sheet-metal and the number and shape of the folds.

The expansion body can have a number of different applications for example as a pile, a spot footing or an anchor body. When used as a pile the non-expanded body is inserted in a predrilled hole or is directly hammered into the ground by a driving hammer. Then the body is expanded by filling it up with pressurized water or concrete. The extent of expansion can be determined by measuring the quantity of the pressurized fluid used, and by measuring the hydraulic pressure of the fluid it is possible to estimate the earth pressure acting on the body. When knowing both the size and the earth pressure, the bearing capacity of the pile can easily be determined. If necessary a steel reinforcement can be inserted in the expanded body or alternatively the body can be filled with concrete reinforced by glass or metallic fibre.

Figures 1, 2, 3, 4:
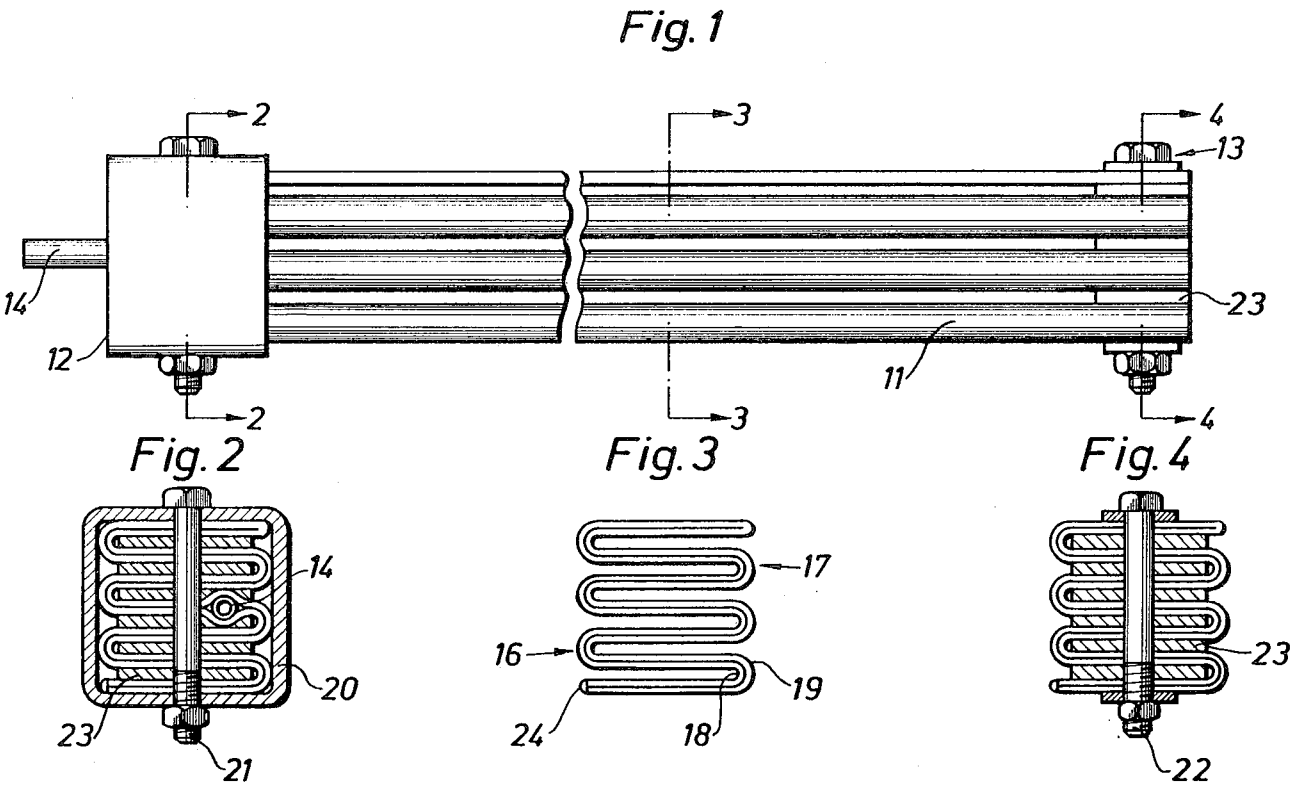
FIG. 1 is a side view of an expansion body according to the invention.
FIGS. 2, 3, and 4 are sectional views taken on lines 2—2, 3—3, and 4—4, respectively, of FIG. 1.
Figure 7:
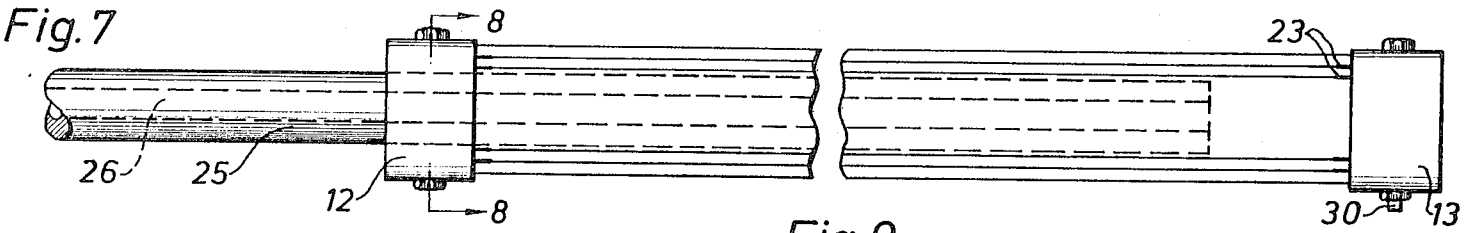
FIG. 7 is a side view of an expansion body used as an anchor body for an anchor rod.
Figure 9:
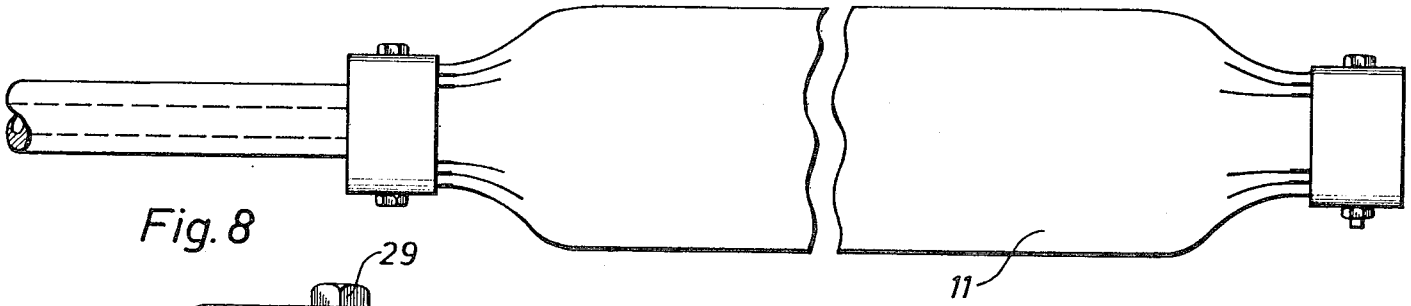
FIG. 9 is a side view of the expanded anchor body.
Figure 8:
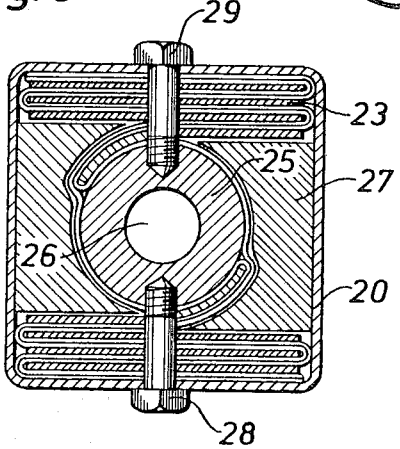
FIG. 8 is a sectional view taken on line 8—8 of FIG. 7 shown in an enlarged scale.
Figure 10:
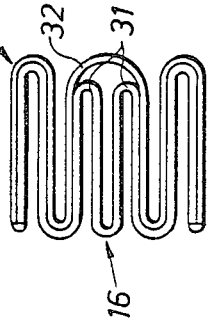
FIG. 10 is a sectional view on an embodiment with another folding arrangement suitable for insertion of an anchor rod therethrough.

An embodiment adapted for use as an anchor body or pile foot is shown in FIGS. 7–9. The expansion body is in principal the same as described above, with a folded casing 11 and forward and rear clamping means 12, 13. An anchor rod 25 or pile rod goes through the forward clamping means 12 into the expansion body. The rod 25 is a suitable steel rod or tube e.g. a drill rod and the pressurized fluid, preferably concrete is inserted through a hole 26 in the rod. The sleeve of the forward clamping means 12 has two filler blocks 27 of plastic material attached to the inner sides in order to fill up the empty spaces that appear in the sleeve depending on the size of the rod cross section. The anchor assembly is manufactured by first enlarging the center fold of a folded casing by a drift in order to make a hole for the rod. Then the rod 25 is inserted in said hole and the clamping means 12 is pressed over the forward end part of the casing. Bolts 28, 29 are going through the folds from two opposite directions, said bolts 28, 29 being arranged for guiding the folds during the unfolding motion and for securing the body to the rod 25 when handling the assembly. The rear clamping means 13 is of the same construction as the forward one but instead of the rod a not shown plug is inserted in the hole in the casing and secured therein by a bolt 30. Alternatively the clamping means 12, 13 could be of the same kind as shown in FIG. 4 in which case the drifted hole should not go through the rear end of the casing. In order to make it easier to prepare said hole, the two portions of the casing could be folded and put together as appears from FIG. 10. In that embodiment two folds 31 of one portion 16 are inserted in one fold 32 of the other portion 17 which simplifies the unfolding by said drift tool in that part.

The anchor assembly is preferably also inserted in a predrilled hole in the ground and expanded by filling it up with concrete. The degree of expansion will in addition to the factors mentioned above also depend on the size and shape of the anchor rod 25. For example when using a rod with a diameter of 38 mm and a sheet-metal of a thickness of 1 mm laid in 9 folds, the non-expanded anchor body is insertable in a hole with a diameter of 125 mm and is then expandable to a cross section with a diameter of 400 mm.

Figure 12:
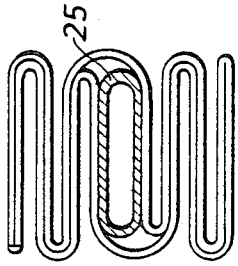
FIGS. 11 and 12 are sectional views showing another two embodiments of an arrangement of the anchor rod within the expansion body.
Figure 11:
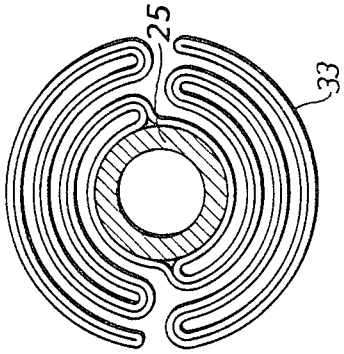

In order to increase the expansion of the anchor body, the shape of the rod and foldings could be adapted to each other as appears from FIGS. 11 and 12. In FIG. 11 the casing is folded in half-circles 33 surrounding a round rod 25 and in FIG. 12 the rod 25 has a flattened cross section adapted to the folds.

Figure 13:
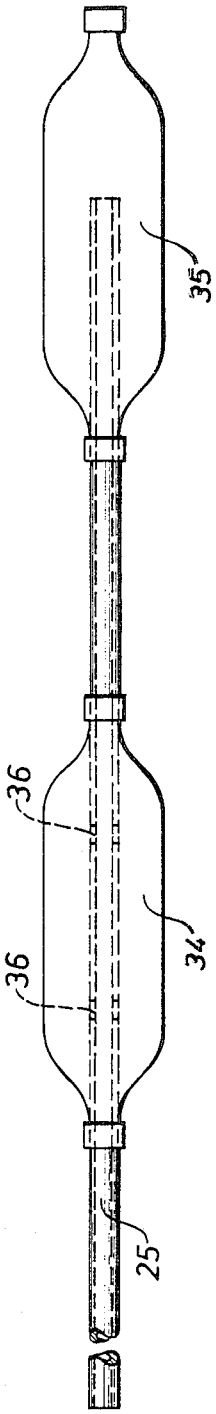
FIG. 13 is a side view of an anchor rod having two expansion bodies attached thereon.

The bearing capacity could be further increased by arranging two or more expansion bodies on one rod (FIG. 13). The rod 25 then traverses th first body 34 and ends within the second 35. The rod 25 includes side openings 36 for the distribution of concrete to the first body 34. If the earth has layers of different compressive or tensile strength, it is possible to adjust the position of the expansion bodies to the layers of maximum strength.

It is to be understood that the invention is not limited to the disclosed examples but can be varied in many ways within the scope of the claims.

I claim:

1. Expansion body for anchoring constructions in the earth, comprising:

a folded elongated sheet metal casing (11) which defines an internal closed space (15);

means (14) for coupling internal closed space (15) to a source of pressurized fluid for the expansion of the expansion body by the pressing out of the folds (18, 19) of the sheet metal casing under the pressure of said pressurized fluid;

said sheet metal casing comprising opposed portions (16, 17), which before said expansion have said folds (18, 19) thereof arranged in zigzag shape with the folds (18) of one of said portions (16) falling into the folds (19) of the other of said portions (17).

2. The expansion body of claim 1, wherein each fold (18) in one of said portions (16) falls into or is enclosed by a mating fold (19) in an opposed portion (17).

3. The expansion body of claim 1 or 2, wherein said folds (18, 19) of said opposed portions (16, 17) before said expansion are tightly adjacent to each other.

4. The expansion body of claim 1, further comprising clamping means (12, 13) on each end part of said elongated sheet metal casing (11) for holding said end parts in said zigzag shape when the other parts of said casing (11) are expanded under the pressure of said pressurized fluid.

5. The expansion body of claim 4, further comprising anti-friction means (23) arranged between one or more of said folds (18, 19) in the clamped end parts of the casing (11).

6. The expansion body of claim 4 or 5, wherein said clamping means (12, 13) comprises an elongated member (21, 22; 27, 28, 29) penetrating said folds (18, 19).

7. The expansion body of claim 6, wherein said elongated member is a bolt penetrating said folds at the clamped end parts of the casing.

8. The expansion body of claim 5, wherein said anti-friction means (23) is arranged between each of said adjacent folds in said clamped end parts of said casing.

9. The expansion body of claim 1, further comprising a load carrying rod (25) connected to said body for transferring tensile or compressive forces acting on the rod (25) to the body.

10. The expansion body of claim 9, wherein said load carrying rod (25) is tubular in shape and projects into said closed space (15) of said casing (11).

11. The expansion body of claim 9, wherein said load carrying rod (25) projects into said closed space (15) of said casing (11).

12. The expansion body of claim 2, further comprising clamping means (12, 13) on each end part of said elongated sheet metal casing (11) for holding said end parts in said zigzag shape when the other parts of said casing (11) are expanded under the pressure of said pressurized fluid.

13. The expansion body of claim 12, further comprising anti-friction means (23) arranged between one or more of said folds (18, 19) in the clamped end parts of the casing (11).

14. The expansion body of claim 3, further comprising clamping means (12, 13) on each end part of said elongated sheet metal casing (11) for holding said end parts in said zigzag shape when the other parts of said casing (11) are expanded under the pressure of said pressurized fluid.

* * * * *